US010054409B2

(12) United States Patent
Vanderheyden

(10) Patent No.: US 10,054,409 B2
(45) Date of Patent: Aug. 21, 2018

(54) ARROWHEAD FOR BOWHUNTING

(71) Applicant: William Joseph Vanderheyden, Loveland, CO (US)

(72) Inventor: William Joseph Vanderheyden, Loveland, CO (US)

(73) Assignee: William Vanderheyden, Loveland, CO (US)

( * ) Notice: Subject to any disclaimer, the term of this patent is extended or adjusted under 35 U.S.C. 154(b) by 2 days.

(21) Appl. No.: 15/640,185

(22) Filed: Jun. 30, 2017

(65) Prior Publication Data

US 2018/0010894 A1 Jan. 11, 2018

Related U.S. Application Data

(60) Provisional application No. 62/360,464, filed on Jul. 10, 2016.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 2,137,014 A * 11/1938 Brochu ..... F42B 6/08 473/583
2,829,894 A * 4/1958 Henkel ..... F42B 6/08 473/584
5,931,751 A * 8/1999 Cooper ..... F42B 6/08 473/583
7,597,637 B2 * 10/2009 Sohm ..... F42B 6/08 473/583
7,871,345 B2 * 1/2011 Cooper ..... F42B 6/08 473/584
8,100,788 B2 * 1/2012 Sanford ..... F42B 6/08 473/582

* cited by examiner

*Primary Examiner* — John Ricci

(57) ABSTRACT

The present invention is an improved arrowhead for bowhunting. Furthermore, it is an arrowhead with improved blade strength and blade retention. A ferrule is included in the arrowhead and is used to connect the blades to the arrow shaft. The ferrule has an open slot and a closed slot perpendicular to each other which receive a primary blade and a secondary blade. The two blades interlock by the use of notches along the edges of the two blades that fit together within the open slot. The primary blade has an angle at the tip that is larger than the angle on the remainder of the primary blade improving the strength at the tip of the arrowhead.

20 Claims, 10 Drawing Sheets

ARROWHEAD FOR BOWHUNTING

CROSS-REFERENCE TO RELATED APPLICATIONS

This application claims priority to Provisional Patent Application No. 62/360,464, filed on Jul. 10, 2017, which is incorporated herein by reference in its entirety.

BACKGROUND OF THE INVENTION

1. Field of the Invention

Arrows have long been used for target archery and hunting. A conventional arrow has a shaft with fletching, a knock at one end to receive the bow string, and an arrowhead at the other end. Arrowheads used for hunting typically have one or more sharp cutting blades and a ferrule that retains the blades and connects them to the arrow shaft.

2. Description of the Related Art

A common hunting arrowhead design includes a primary triangular shaped blade attached to a ferrule with the blade protruding wider than the arrow shaft on both sides and extending in front of the ferrule to form a pointed tip of the arrowhead. U.S. Pat. No. 2,137,014 issued on Nov. 15, 1938 to Arthur J. Brochu shows an arrowhead of this type.

In this type of arrowhead, the primary blade typically has two straight cutting edges coming together at a one angle all the way to the tip. This can cause the blade to be long and narrow at the tip. The blade tip is relatively weak and commonly breaks when impacting hard objects such as bone.

A secondary blade, much smaller and not extending to the tip, is commonly added to this type of arrowhead to create a second cut perpendicular to the primary blade. This cross-shaped cut opens up a bigger hole for blood to escape through the hide for better blood tracking as compared to a single primary blade alone. U.S. Pat. No. 2,829,894 issued on Apr. 8, 1958 to Edward J. Henkel shows this type of arrowhead with a secondary blade. In Henkel's design, the secondary blade is inserted through a slot in the ferrule and rear tabs snap into recesses in the ferrule. A common problem with secondary blades is that they become dislodged when impacting hard objects such as bone.

BRIEF SUMMARY OF THE INVENTION

The present invention is an improved arrowhead for bowhunting. Furthermore, it is an arrowhead with improved blade strength and blade retention.

A ferrule is included in the arrowhead and is used to connect the blades to the arrow shaft. The ferrule has an open slot and a closed slot perpendicular to each other. In the new arrowhead, a primary blade is contained in the open slot. The primary blade protrudes wider than the ferrule on both sides and extends in front of the ferrule to form a tip. A secondary blade is also included in the arrowhead and is contained in the closed slot. The two blades interlock by the use of notches along the edges of the two blades that fit together. A screw is included in the arrowhead and passes through the ferrule and the primary blade, thereby retaining both blades in a superior manner while also allowing the blades to be removed for re-sharpening or replacement.

With the new arrowhead design, the primary blade has improved impact strength at the tip. The angle at the tip is larger than the angle on the remainder of the primary blade. This makes the tip shorter and wider as compared to a single angle blade, providing superior strength which is useful to reduce the potential for breaking when the tip strikes a hard object such as bone. In one exemplary preferred embodiment, the angle at the tip of the primary blade is in the range of 70-100 degrees with an edge length of 0.15 to 0.50 inches.

DETAILED DESCRIPTION OF THE INVENTION

Figure 1:
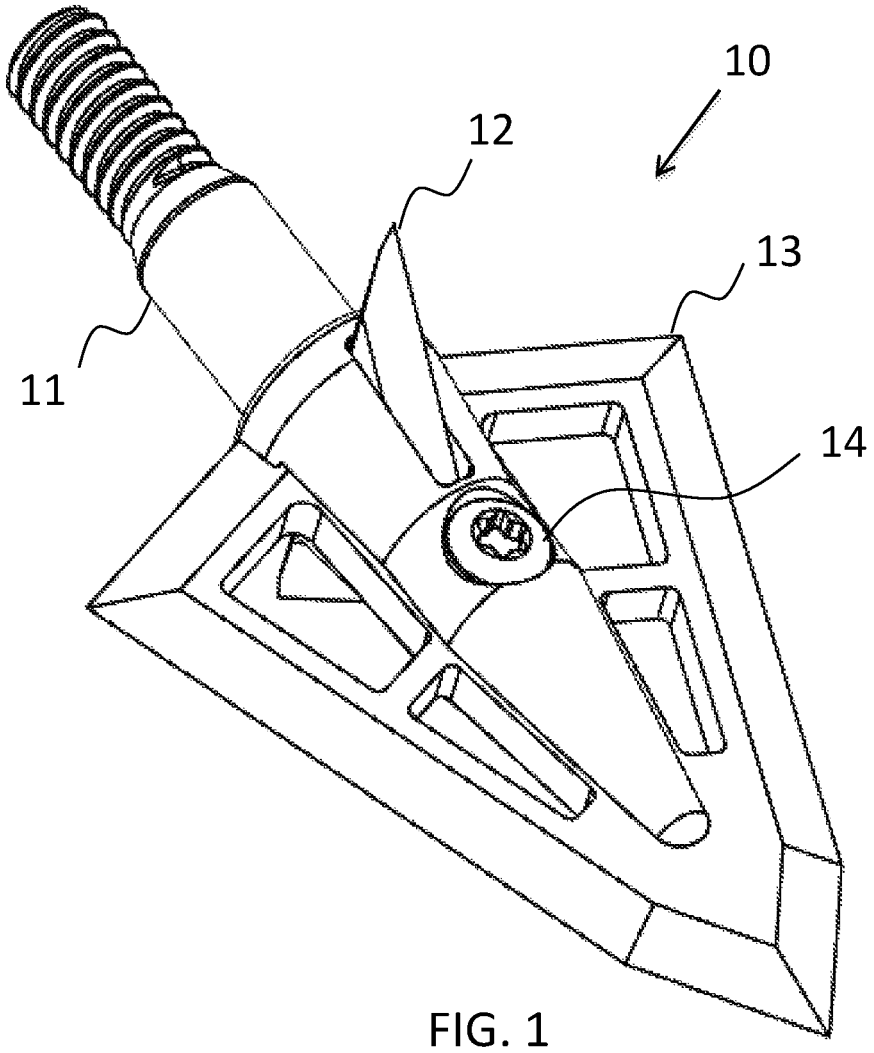
FIG. 1 is a perspective view of the arrowhead in one embodiment of the present invention.
Figure 2:
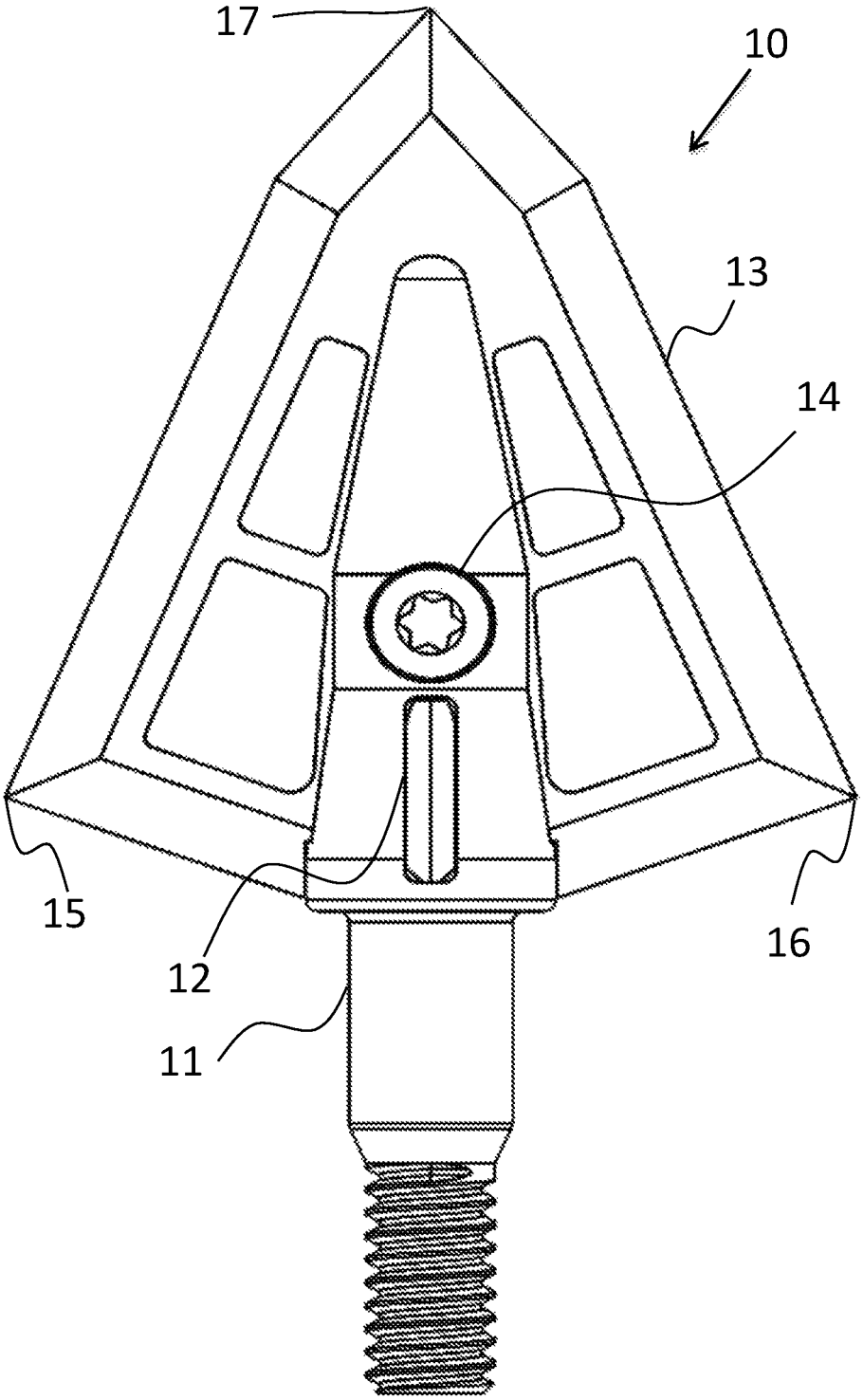
FIG. 2 is a plan view of the arrowhead of FIG. 1.
Figure 3:
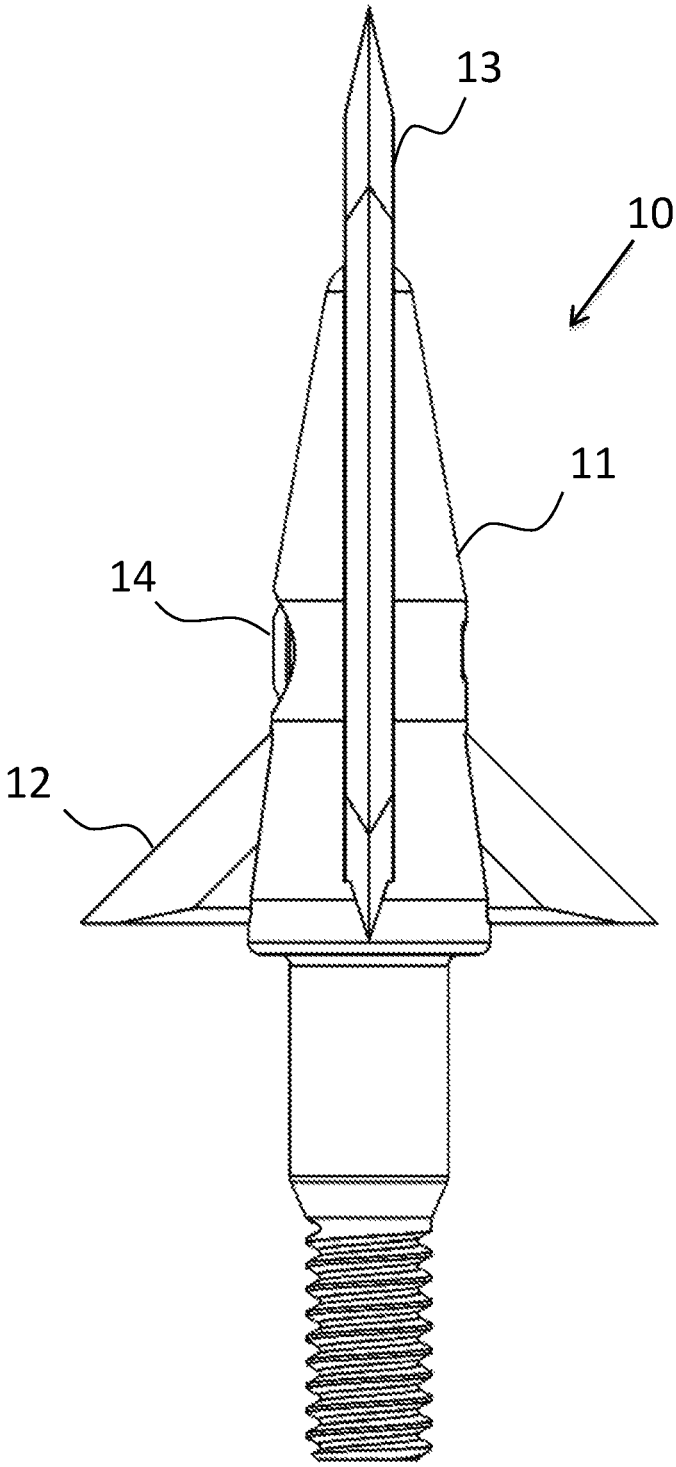
FIG. 3 is an elevation view of the arrowhead of FIG. 1.

The following describes an arrowhead for hunting that is configured for addressing problems associated with the strength of an arrowhead including the strength of the primary blade tip and the secondary blade retention. FIG. 1 is a perspective view of the arrowhead 10. The arrowhead 10 components include a ferrule 11, a secondary blade 12, a primary blade 13, and a screw 14. FIG. 2 is a plan view of the arrowhead 10 of FIG. 1. It can be seen in FIG. 2 that the primary blade 13 protrudes wider than the ferrule 11, extending to the first side widest point 15 and the second side widest point 16. It can also be seen in FIG. 2 that the primary blade 12 extends in front of the ferrule 11 forming a pointed tip 17. FIG. 3 is an elevation view of the arrowhead 10 of FIG. 1. From FIG. 3, it can be seen that the secondary blade 12 is oriented perpendicular to the primary blade 13.

Figure 4:
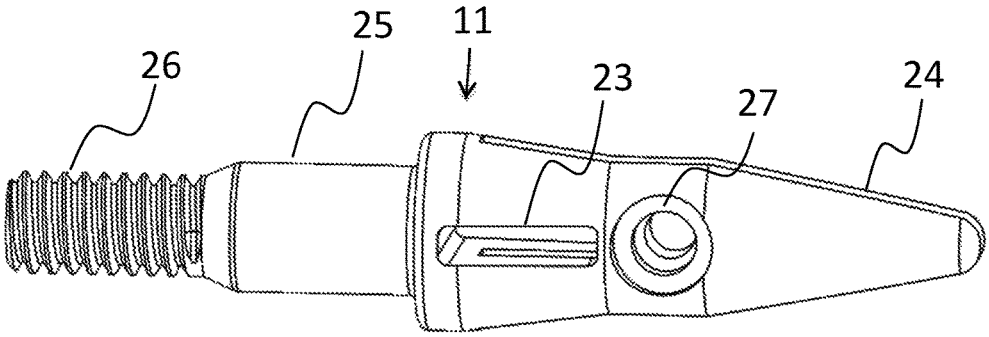
FIG. 4 is a perspective view of the ferrule of the arrowhead of FIG. 1.

FIG. 4 is a perspective view of the ferrule 11 of the arrowhead 10 of FIG. 1. The ferrule 11 includes a locating cylindrical base 25 with a diameter chosen such that the base 25 fits precisely inside an end of an arrow shaft, not shown. The ferrule 11 also includes a male threaded section 26 adjacent the base 25 which mates with threads inside the arrow shaft to hold it securely to the arrow shaft. The locating diameter and threads of the base 25 and threaded section 26 are standard in the archery industry for replacement point systems.

Figure 5:
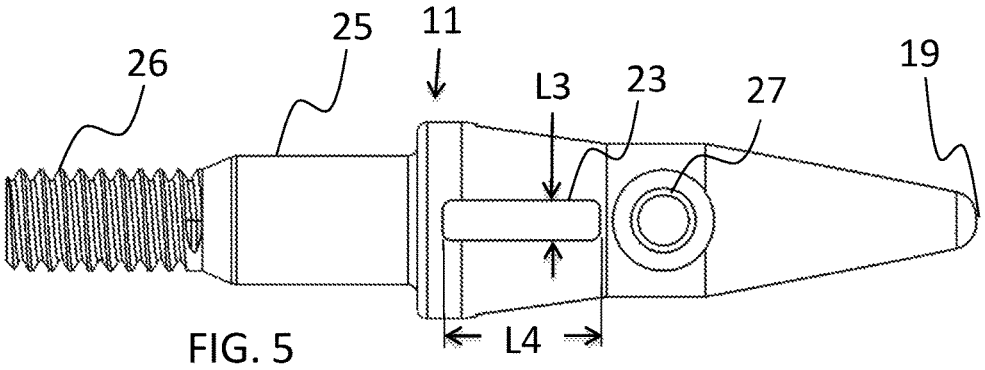
FIG. 5 is a plan view of the ferrule of FIG. 4.
Figure 6:
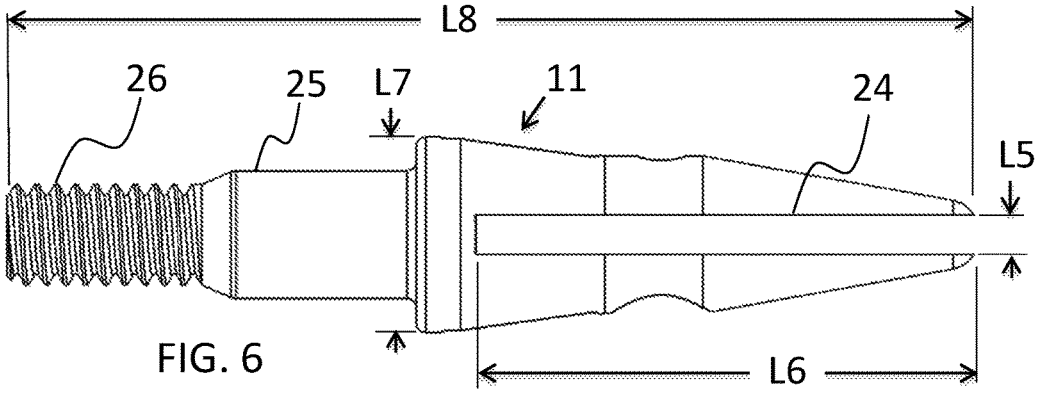
FIG. 6 is an elevation view of the ferrule of FIG. 4.

FIG. 5 is a plan view of the ferrule 11 of FIG. 4. The ferrule 11 includes a closed slot 23 which creates a hole through the body of the ferrule 11. This slot 23 is referred to as a closed slot since there is material on all sides of the slot as can be seen in FIG. 5. FIG. 6 is an elevation view of the ferrule 11 of FIG. 4. The ferrule 11 also includes an open slot 24 which extends all the way to the tip 19 of the ferrule 11. This slot 24 is referred to as an open slot since no material is enclosing the right end of the slot 24 as shown in FIG. 6.

The open slot 24 is perpendicular to the closed slot 23. The open slot 24 overlaps the closed slot 23 by an exemplary range of 50 to 90 percent of the closed slot's length L4. The width L5 of the open slot 24 is 0.001 to 0.010 inches wider than the thickness of the primary blade. The width L3 of the closed slot 23 is 0.001 to 0.010 inches wider than the thickness of the secondary blade. The length L4 of the closed slot 23 is in the exemplary range of 0.15 to 0.50 inches. The length L6 of the open slot 24 is in the exemplary range of 0.5 to 1.0 inches. The ferrule 11 also includes a threaded screw hole 27 that passes through the entire body of the ferrule 11 including the open slot 24. The axis of hole 27 is perpendicular to the planar slot 24. Hole 27 is spaced apart from and between the tip 19 of the body of the ferrule 11 and the closed slot 23. The ferrule 11 has a length L8 in the exemplary range of 1.2 to 2.0 inches. The ferrule 11 has a width L7 in the exemplary range of 0.25 to 0.35 inches. The ferrule 11 would commonly be made from metal such as aluminum, titanium, or steel using a lathe or screw machine.

Figure 7:
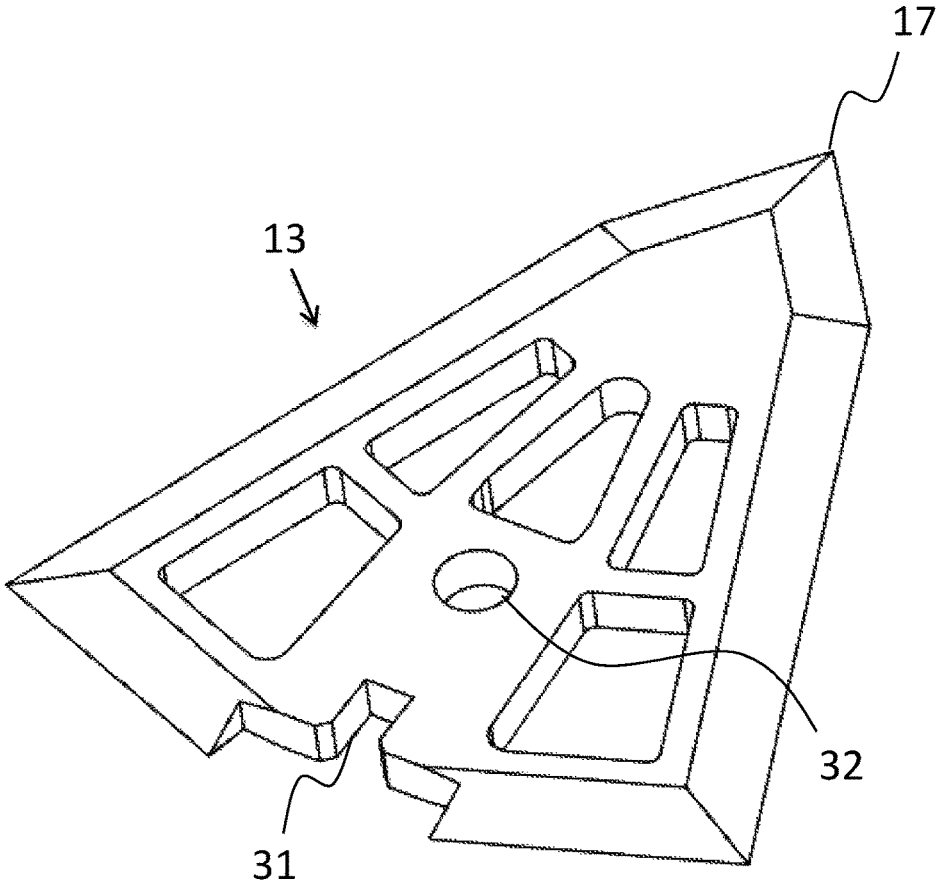
FIG. 7 is a perspective view of the primary blade of the arrowhead of FIG. 1.

FIG. 7 is a perspective view of the primary blade 13 of the arrowhead 10 of FIG. 1. The primary blade 13 is commonly made from a plate of metal such that it has a constant thickness of 0.045 to 0.100 inches except where material has been removed for instance by a stamping die process or by grinding the cutting edges to a sharp bevel of 15 to 30 degrees per side. The primary blade 13 includes a notch 31 and a hole 32. The remaining holes through the blade shown in FIG. 5 are included for weight reduction and could also be removed for this invention. The primary blade 13 is symmetrical about its centerline which passes through the point of the tip 17 and the hole 32 center.

Figure 8:
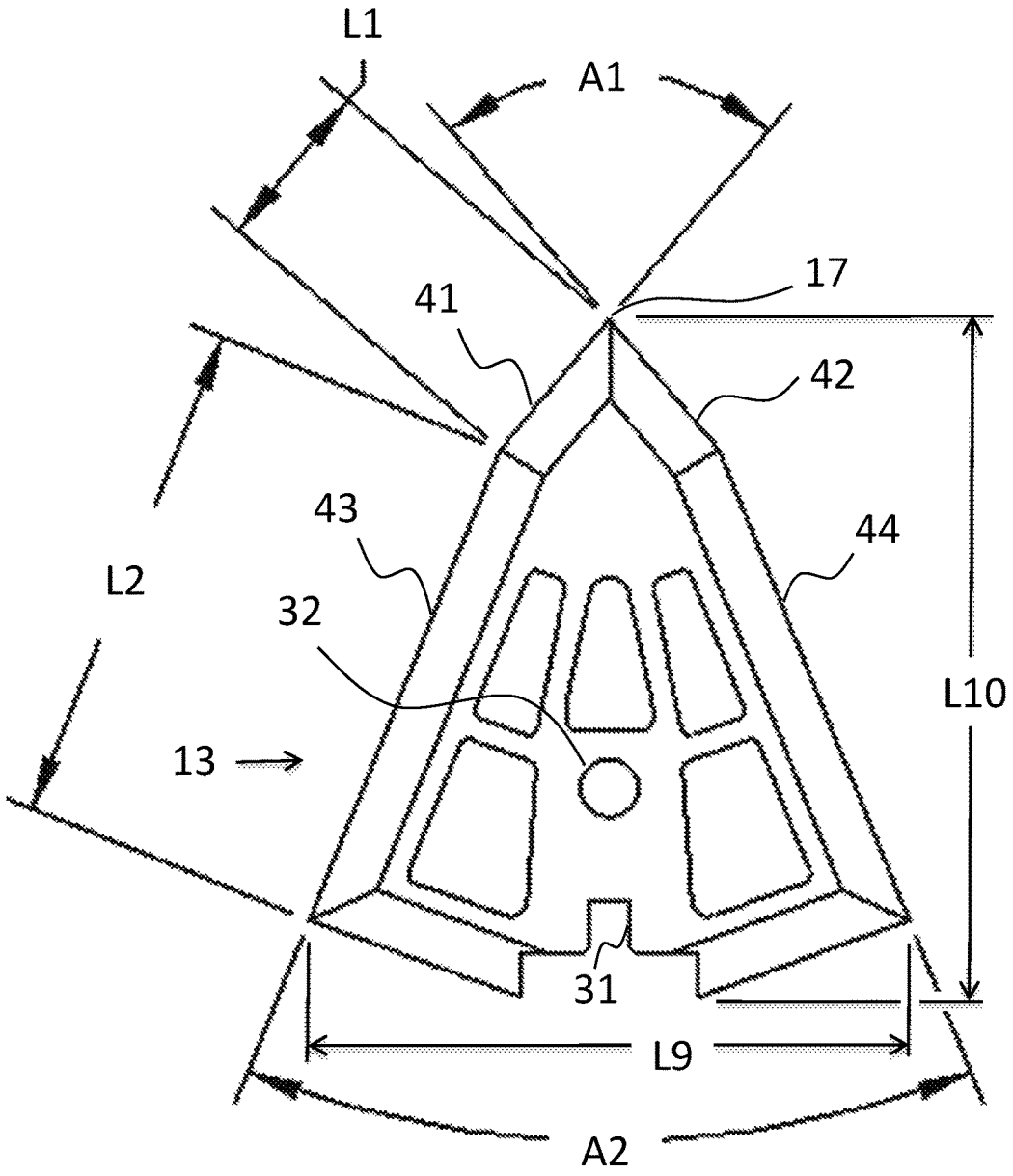
FIG. 8 is a plan view of the primary blade of FIG. 7.

FIG. 8 is a plan view of the primary blade 13 of FIG. 7. A first set of cutting edges 41 and 42 starting at tip 17 form a first angle A1. A second set of cutting edges 43 and 44 form a second angle A2. The first angle A1 starting from the blade tip 17 is larger than the second angle A2. The first angle A1 is in the exemplary range of 70 to 100 degrees, but preferably about 80 degrees. The second angle A2 is in the exemplary range of 25 to 60 degrees, but preferably about 45 degrees. The first set of cutting edges have a length L1 and the second set of cutting edges have a length L2. Length L1 is in the exemplary range of 0.15 to 0.5 inches, but preferably about 0.3 inches. Edge length L2 can be adjusted to achieve a desired length and width of the arrowhead, but is preferably in the range of 0.6 to 1.0 inches. The length L10 of the primary blade 13 is in the exemplary range of 0.9 to 1.4 inches. The width L9 of the primary blade 13 is in the exemplary range of 0.9 to 1.5 inches.

Figure 9:
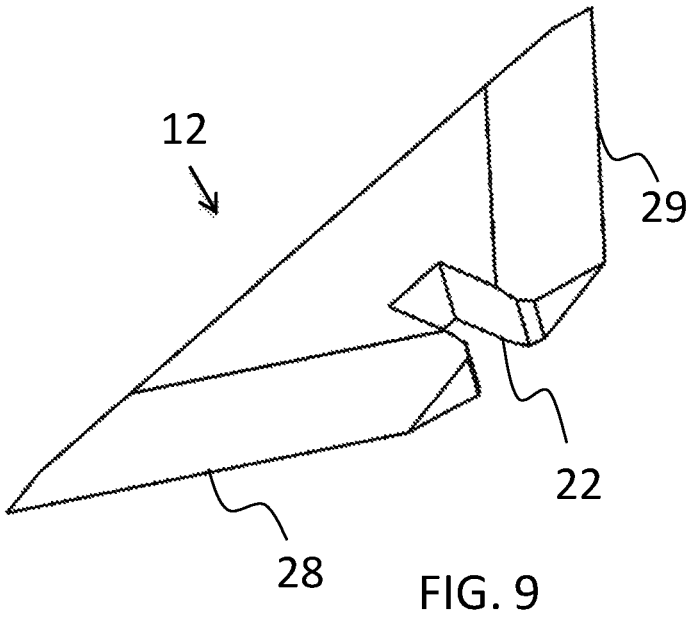
FIG. 9 is a perspective view of the secondary blade of the arrowhead of FIG. 1.

FIG. 9 is a perspective view of the secondary blade 12 of the arrowhead 10 of FIG. 1. The secondary blade 12 is commonly made from a plate of metal such that it has a constant thickness of 0.040 to 0.080 inches except where material has been removed for instance by a stamping die process or by grinding the edges to a sharp bevel of 15 to 30 degrees per side. The secondary blade 12 includes a notch 22 and two cutting edges 28 and 29.

Figure 10:
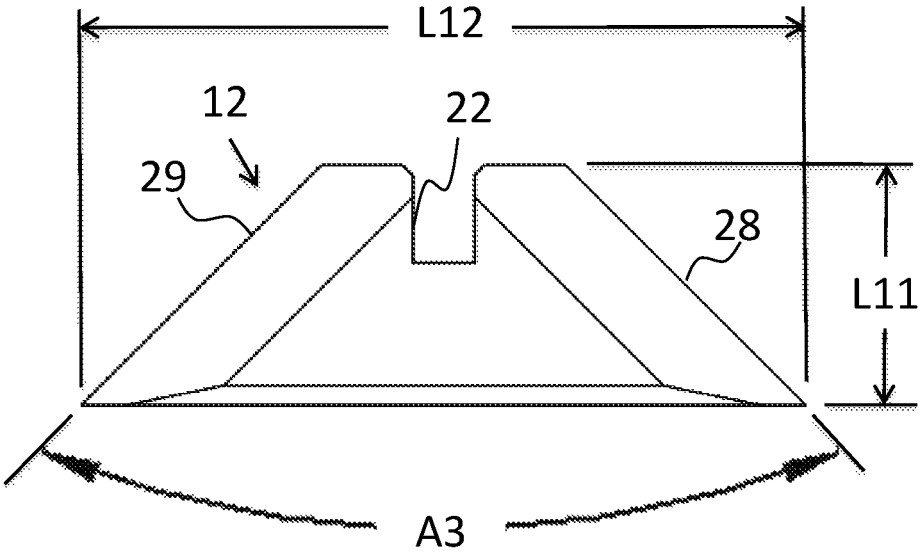
FIG. 10 is a plan view of the secondary blade of FIG. 9.

FIG. 10 is a plan view of the secondary blade 12 of FIG. 9. The secondary blade 12 has a width L12 in the exemplary range of 0.5 to 1.0 inches and a length L11 in the exemplary range of 0.15 to 0.50 inches. The secondary blade 12 has an angle A3 in the exemplary range of 60 to 110 degrees.

Figure 11:
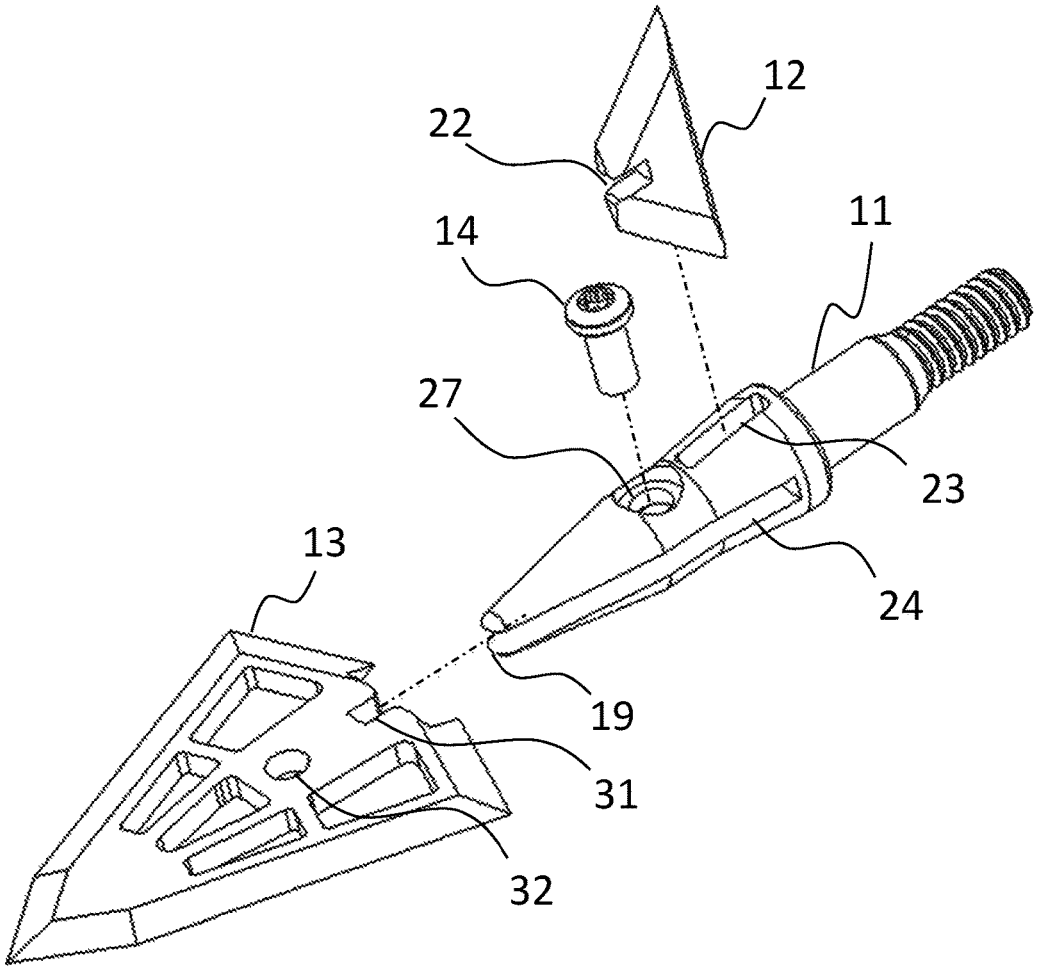
FIG. 11 is an exploded view of the arrowhead of FIG. 1.

FIG. 11 is an exploded view of the arrowhead 10 of FIG. 1. FIG. 11 has dashed lines showing the positioning of the components during assembly. First, the secondary blade 12 is inserted into the closed slot 23 in the side of the body of the ferrule 11 until it is centered within the body of the ferrule 11 with the notch 22 facing toward the tip 19 of the body of the ferrule 11 and aligned with open slot 24. The primary blade 13 is then inserted into the open slot 24 of the ferrule 11 (to be centered in the body of the ferrule 11 with the notch 31 centered in the open slot 24) from the tip 19 backward until the primary blade 13 contacts the back of the slot 24 and the notch 31 of the primary blade 13 interlocks with notch 22 of the secondary blade 12. The screw 14 is then assembled into the screw hole 27 of the ferrule 11 passing through the hole 32 of the primary blade 13. The screw 14 and the screw hole 27 both include threads which are not shown in this simplified view.

Figure 12:
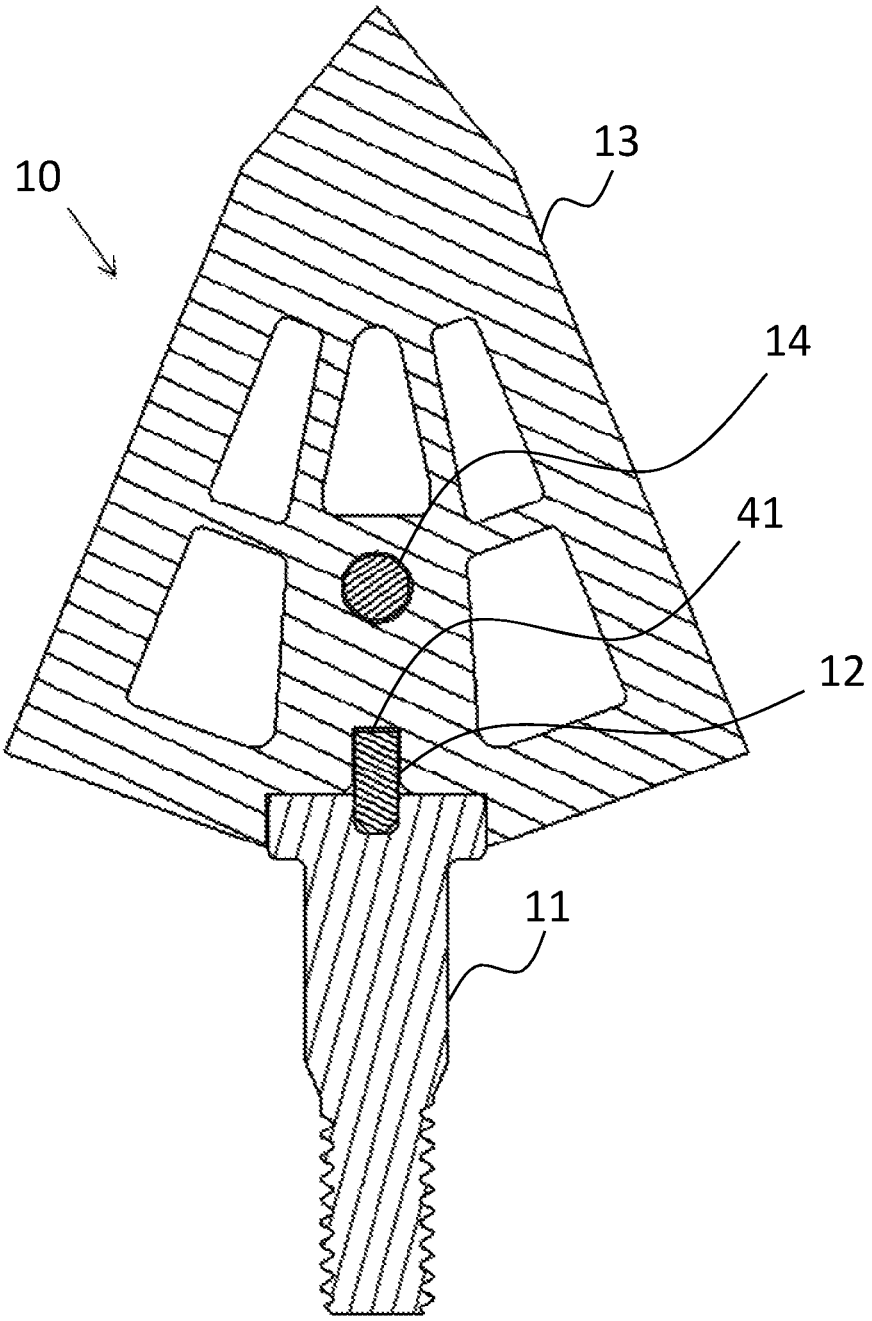
FIG. 12 is a plan section view of the arrowhead of FIG. 1.
Figure 13:
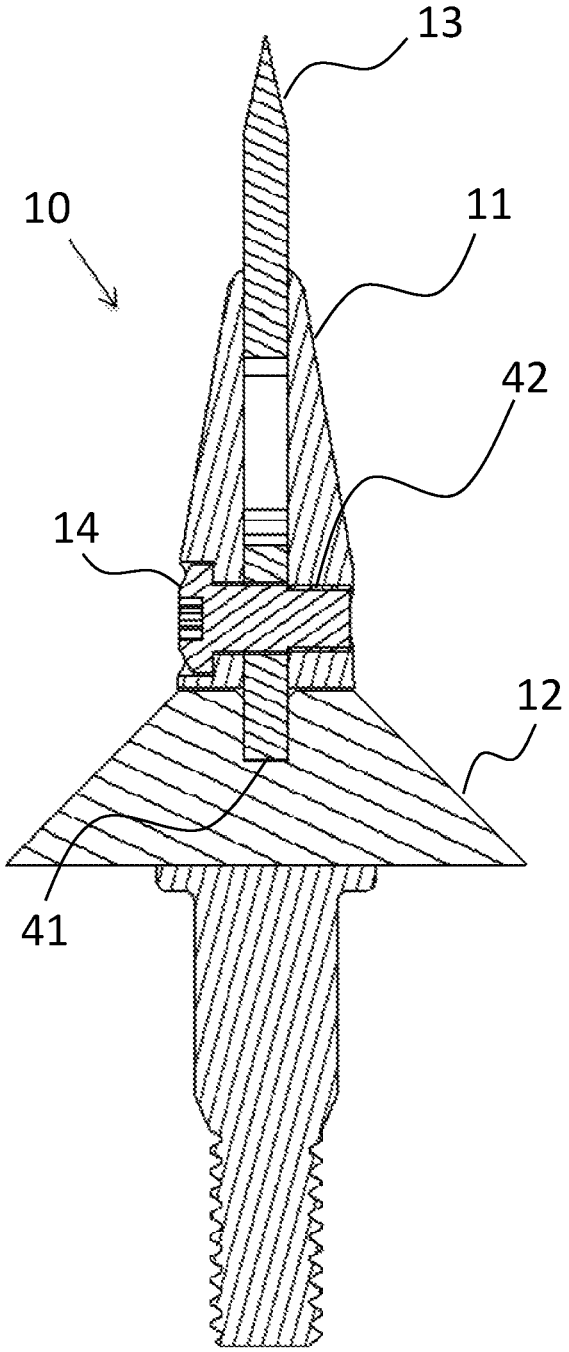
FIG. 13 is an elevation section view of the arrowhead of FIG. 1.

FIG. 12 is a plan section view through the center of the arrowhead 10 of FIG. 1 showing the components in their secured positions from this perspective. The screw 14 secures the primary blade 13 to the ferrule 11. The notches of the primary blade 13 and secondary blade 12 interlock and mate at position 41. FIG. 13 is an elevation section view through the center of the arrowhead 10 of FIG. 1 showing the components in their secured positions from this perspective. The screw 14 secures the primary blade 13 to the ferrule 11. The notches of the primary blade 13 and secondary blade 12 interlock and mate at position 41. Position 42 shows the location of the thread engagement on the screw 14 and the ferrule 11.

The above described embodiments include the preferred embodiment and the best mode of the invention know to the inventor.

The invention claimed is:

1. An arrowhead comprising:

a ferrule;

a triangular shaped blade attached to the ferrule, the blade protruding a first distance from opposite sides of the ferrule and extending a second distance in front of the ferrule to form a tip of the arrowhead and the blade having a first set of cutting edges having a first angle and a second set of cutting edges having a second angle, wherein the first set of cutting edges form the tip, wherein the first angle is in the range of 70 to 100 degrees, wherein the first set of cutting edges have a length, and wherein the length is in the range of 0.15 to 0.50 inches.

2. The arrowhead of claim 1 wherein the length of the first set of cutting edges is in the range of 0.2 to 0.4 inches.

3. The arrowhead of claim 1 wherein the second angle is in the range of 25 to 60 degrees.

4. The arrowhead of claim 1 wherein the second set of cutting edges have a length and wherein the length of each of the cutting edges in the second set is in the range of 0.6 to 1.0 inches.

5. The arrowhead of claim 1 wherein the blade has a thickness and wherein the thickness is in the range of 0.045 to 0.100 inches.

6. The arrowhead of claim 1 wherein the blade has a length and wherein the length is in the range of 0.90 to 1.40 inches.

7. The arrowhead of claim 1 further comprising:

a second blade attached to the ferrule, wherein the second blade is perpendicular to the triangular shaped blade.

8. An arrowhead comprising:

a ferrule having an open slot and a closed slot, wherein the open slot is perpendicular to the closed slot;

a first blade received in the open slot;

a second blade received in the closed slot, wherein the first blade and the second blade have a pair of interlocking notches positioned within the open slot, and wherein the second blade has a body with a truncated triangle shape with a linear upper side that extends parallel to an upper side of the closed slot.

9. The arrowhead of claim 8 further comprising a fastening device extending through the ferrule and the first blade.

10. The arrowhead of claim 9 wherein the fastening device is removable.

11. The arrowhead of claim 8 wherein the second blade notch opening faces in the direction of the tip of the arrowhead and the first blade notch opening faces in the direction away from the tip of the arrowhead.

12. The arrowhead of claim 8, wherein the first blade is a triangular shaped blade, the blade protruding from opposite sides of the ferrule and extending outward from an end of the ferrule to form a tip of the arrowhead.

13. The arrowhead of claim 12, wherein the first blade has a first set of cutting edges forming a first angle and a second set of cutting edges forming a second angle;

wherein the first angle forms the tip of the arrowhead and is in the range of 70 to 100 degrees;

wherein the first set of cutting edges have a length in the range of 0.15 to 0.50 inches.

14. The arrowhead of claim 12, wherein the first blade has a first set of cutting edges forming a first angle and a second set of cutting edges forming a second angle;

wherein the first angle forms the tip of the arrowhead and is in the range of 70 to 100 degrees;

wherein the first set of cutting edges have a length in the range of 0.2 to 0.40 inches.

15. An arrowhead comprising:

a ferrule;

a first blade and a second blade attached to the ferrule, the first blade being triangular shaped, the first blade having a width that is greater than a width of the ferrule such that the first blade protrudes from opposite sides of the ferrule and the first blade extending a distance outward from an end of the ferrule to form a tip of the arrowhead, and the first blade having a first set of cutting edges having a first angle and a second set of cutting edges having a second angle;

wherein the first set of cutting edges form the tip, wherein the first angle is between 70 and 100 degrees, wherein the first set of cutting edges have a length, wherein the length is between 0.15 and 0.50 inches, wherein the ferrule has an open slot and a closed slot, wherein the open slot is perpendicular to the closed slot, whereby the closed slot extends through the open slot, wherein the first blade is positioned in the open slot, wherein the second blade is positioned in the closed slot, and wherein the first blade and the second blade have interlocking notches that mate together within the open slot, and wherein the second blade has a body with a truncated triangle shape with a linear upper side that extends parallel to an upper side of the closed slot.

16. The arrowhead of claim 15, wherein the first angle is greater than the second angle.

17. The arrowhead of claim 15, wherein the first set of cutting edges have a length in the range of 0.2 to 0.4 inches.

18. The arrowhead of claim 15, wherein the first blade has a thickness of 0.045 to 0.100 inches.

19. The arrowhead of claim 15, wherein the first blade has a length of 0.90 to 1.40 inches.

20. The arrowhead of claim 15 further comprising a fastening device extending through the ferrule and the first blade.

* * * * *